US005155990A

United States Patent [19]

Pöll

[11] Patent Number: 5,155,990

[45] Date of Patent: Oct. 20, 1992

[54] METAL PLATELET COMPOUND

[75] Inventor: Martin Pöll, Fritzens, Austria

[73] Assignee: Swarovski & Co., Wattens, Austria

[21] Appl. No.: 645,196

[22] Filed: Jan. 24, 1991

[30] Foreign Application Priority Data

Jan. 31, 1990 [DE] Fed. Rep. of Germany ..... 4002818

[51] Int. Cl.[5] ..... F16G 13/00

[52] U.S. Cl. ..... 59/80; 59/82; 29/160.6

[58] Field of Search ..... 59/78, 80, 82, 84; 29/160.6; 63/4

[56] References Cited

U.S. PATENT DOCUMENTS 1,153,362 9/1915 Wacha ..... 59/80
1,476,462 12/1923 Pejchar ..... 59/80
1,787,405 12/1930 Dansereau ..... 59/80
3,931,719 1/1976 Schwab ..... 29/160.6
4,858,425 8/1989 Cheredaryk et al. ..... 59/80

FOREIGN PATENT DOCUMENTS 2425407 12/1975 Fed. Rep. of Germany ..... 59/82

*Primary Examiner*—David Jones
*Attorney, Agent, or Firm*—Fay, Sharpe, Beall, Fagan, Minnich & McKee

[57] ABSTRACT

The invention relates to a metal platelet component comprising metal platelets disposed side by side and connected by linking members. This metal platelet component is characterized by having applied to its underside, i.e. application side, a hot-melt adhesive layer which increases the stability of the metal platelet component and simplifies its handling.

22 Claims, 2 Drawing Sheets

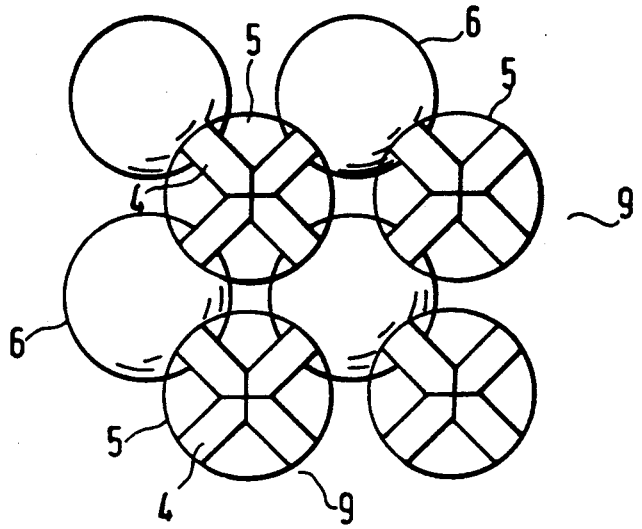
FIG. 1
FIG. 2
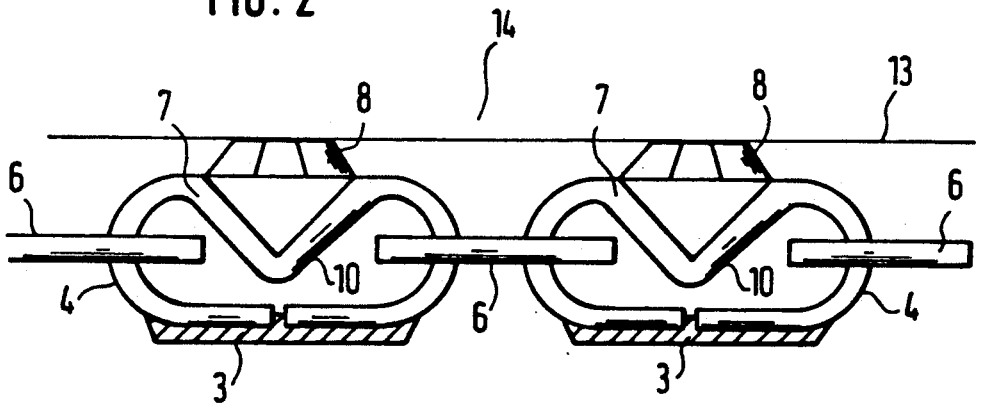

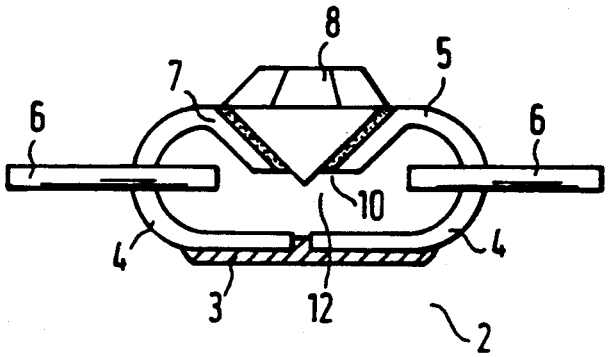
FIG. 3
FIG. 4
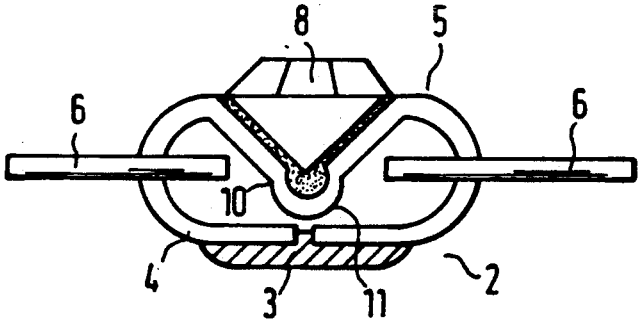

METAL PLATELET COMPOUND

The invention relates to a metal platelet component comprising metal platelets disposed side by side and linked together by linking members. A metal platelet component of the stated type is known and is used e.g. as protection for aprons and gloves in the butchery trade. Such metal platelet components are also used for decorative purposes, for example in the production of handbags, belts, articles of clothing and for application to clothing. Such a metal platelet component is described in DE-OS 38 20 251.4, which is from the applicant. The known metal platelet components generally comprise the metal platelets and linking members. The metal platelets are provided on the circumference with bars which engage the linking members. The component is created by bending these bars on the underside of the metal platelets in such a way that they embrace the linking members in claw-like fashion.

Metal platelet components of the above-described type have considerable disadvantages in their application, in particular when they are used for decorative purposes, for example in the production of handbags and belts and the like. One of these disadvantages is the relatively low stability of the components, which becomes apparent in particular when they are used to make objects subject to high mechanical stress such as handbags and belts. Under high stress the bars tend to bend up, thereby destroying the link. A further disadvantage involves the actual production of the objects. For example, if several metal platelet components of different designs or colors are to be joined together to form a large decorative object, it is necessary to open the link at the seams, thread together the individual pieces and produce the link again by bending the bars. This procedure is troublesome and time-consuming in view of the smallness of the individual metal platelets and therefore causes a high cost factor.

The present invention was therefore based on the problem of providing a metal platelet component having improved stability. Simultaneously, the new metal platelet component was to be easier to handle when used to produce decorative objects in order to ensure a maximum possibilities of variation with respect to the combination of different metal platelet component units.

This problem is solved according to the invention by applying a hot-melt adhesive layer to the application side of the metal platelet component.

The hot-melt adhesive layer, which is applied to the underside, i.e. the application side, of the metal platelet component, causes the bars embracing the linking members in claw-like fashion to be glued to each other and to the linking members. This, results in greater stability of the metal platelet component. The bars can no longer bend up under mechanical stress such as tension or elongation. The hot-melt adhesive layer also makes the metal platelet component easier and more versatile in its handling. Units with different color designs, forms and sizes can be easily joined together to form a decorative part by being ironed onto a carrier material, such as fabric or leather. The heat causes the hot-melt adhesive to melt and penetrate into the carrier material, thereby creating after cooling a stable bond between the metal platelet component and the carrier material. The carrier material itself can then be joined to the desired decorative object by sewing or gluing. It is particularly advantageous in this connection that individual pieces of the metal platelet component no longer need to be threaded together but can be simply glued to each other.

In a preferred embodiment of the inventive metal platelet component, the hot-melt adhesive layer is applied to the application side only in the area of the claws of the metal platelets and not on the linking members. One thereby obtains the same advantages, namely the greater stability of the component and simple handling. Furthermore, the natural movability of the metal platelet component is retained, i.e. the claws embrace the linking members but are not glued to them. The individual metal platelets are thus still movable with respect to each other.

In a further preferred embodiment of the inventive metal platelet component, the metal platelet component is coated with the hot-melt adhesive layer only in the area of the edges. In this case one can also combine individual units of different metal platelet components into a greater unit by ironing the individual units onto a suitable carrier material. A particular advantage of this embodiment is that the individual metal platelet components are glued to the carrier material only in their edge areas, i.e. not over the entire surface. This means that the natural movability of the metal platelet component and the resulting decorative effect, is largely retained.

In a further preferred embodiment of the inventive metal platelet component, the metal platelets have a depression for taking up a gem. Gems used may be, in particular, semiprecious stones such as jade, rose quartz, lapis lazuli, onyx and the like. Metal platelet components of such a design can be combined into particularly decorative patterns.

A particularly decorative embodiment of the inventive metal platelet component is obtained if the gems are made of cut glass.

In a very advantageous embodiment of the metal platelet component, the gems are affixed in the depressions in the metal platelets by means of a thermostable adhesive. This makes it easy to mount the gems, the adhesive being applied either to the gems themselves or to the depressions. The use of a thermostable adhesive prevents the gems from coming out of the depressions when the metal platelet component is ironed onto the carrier material.

The depression is expediently of cone-shaped design, in particular if the gems have a conical mounting portion as in the case of cut glass stones. This allows for a largely positive-locking fit of the gems in the depressions.

It is also advantageous for the conical depression in the metal platelet to be designed as a truncated cone with a hole at the apex of the cone. This prevents lacquer or adhesive from accumulating in the apex of the cone when the platelets are lacquered or the gems are glued into the depressions, thereby permitting the mounting portion of the gem to be fit well into the conical depression in the metal platelet.

It is also advantageous to give the conical depression at the apex of the cone a sack-shaped enlargement. This creates a space for lacquer or adhesive to accumulate, so that one can dispense with the operation of punching the metal platelet and nevertheless obtain a reliable fit of the mounting portion of the gem in the conical depression of the metal platelet. The metal platelets are preferably made of eloxed aluminum or brass. Lacquered metal is also decorative.

The metal platelet component can be coated with the hot-melt adhesive layer in different ways.

One possibility is to heat the otherwise finished band to 120° C. and dip it with its underside into finely doctored off hot-melt adhesive powder. During cooling the hot-melt adhesive layer forms.

Another possibility is to roll a binder onto the application side of the otherwise finished metal platelet component. The binder used can be, in particular, an epoxy or polyester lacquer. While still wet, the thus prepared band is then dipped into powdered hot-melt adhesive. The adhesive is then melted down by infrared radiation. This coating method makes it possible in particular for the hot-melt adhesive layer to be applied only in the area of the claws of the metal platelets.

Exemplary embodiments of the present invention are shown in the drawings and shall be described in more detail in the following.

FIG. 1 shows the underside of the metal platelet component;

FIG. 2 shows a vertical partial section through a row of platelets of the metal platelet component;

FIG. 3 shows a further embodiment of a platelet of the metal platelet component with a conical depression having a hole at the apex;

FIG. 4 shows a further embodiment of a platelet of the metal platelet component having a conical depression which is enlarged at the apex.

FIG. 1 shows the arrangement of metal platelets 5 and linking members 6 relative to each other and of the underside, i.e. of application side 2. In the form shown, metal platelets 5 are circular and have bars or claws 4 on the circumference and mutually offset by 90°, each engaging linking member 6. Bars 4 embrace linking members 6 in claw-like fashion and are bent down toward the middle of metal platelets 5. Linking members 6 are expediently ring-shaped, while metal platelets 5 can have any shape suitable for forming a network. For example, they can be hexagonal or octagonal. Forms greatly deviating from the circular shape in their extrapolation, such as ovals, are also conceivable. Depending on the form, however, one might have to vary the length of bars 4 or the diameter of linking members 6 relative to each other in order to obtain a uniform interlacing. This metal platelet component is provided with a hot-melt adhesive layer 3 in the area of bent claws 4. In a particularly preferred embodiment, hot-melt adhesive layer 3 is applied only to edges 9 of the component.

The hot-melt adhesives used may be any plastics material that softens reversibly when heat is supplied. Such materials include polyolefins and polyvinyl components consisting of linear molecular chains or with thermolabile crosslinking. Polyolefins and polyvinyl components as well as copolymers such as ABS and SAN, polyamides, polyacetals, polycarbonates, polyesters can also be used.

FIG. 2 shows one of the preferred embodiments as a vertical partial section through a row of platelets of the metal platelet component. Bars 4 of metal platelets 5 embrace linking members 6 in claw-like fashion. The metal platelets have conical depressions 7 for taking up gems 8. Application side 2 of the metal platelet component is coated with a hot-melt adhesive layer 3 in the area of inwardly bent bars 4. A transfer foil 13 is applied to the top of the metal platelet component.

This transfer foil 13 is removed from top 14 after the metal platelet component is ironed on. It is, firstly, for better storage of the metal platelet component until use and, secondly, protects the metal platelet component during ironing on.

Gems 8 are affixed in depressions 7 by means of a thermostable adhesive. The thermostable adhesives used may be phenoplasts, aminoplasts, epoxy resins, acrylic and alkyd resins and unsaturated polyester resins.

FIG. 2 also shows how hot-melt adhesive layer 3 contributes to increasing the stability of metal platelet component 1. When metal platelet component 1 is coated with the hot-melt adhesive, the latter also penetrates between the points of contact of individual bars 4 (cf. FIG. 1), thereby gluing together individual bars 4 which embrace linking members 6 in claw-like fashion. This largely prevents the bars from bending up under tension or pressure.

FIGS. 3 and 4 show particular and preferred embodiments of depressions 7 in metal platelets 12. In FIG. 3 the conical depression has a hole 12. In FIG. 4 conical depression 7 is enlarged in a sack shape to take up gem 8. Both embodiments prevent excess lacquer or adhesive from impairing the fit of gem 8 in depression 7. Together with hot-melt adhesive 3 on application side 2, this creates an extremely stable metal platelet component 1.

I claim:

1. A metal platelet component to be used in association with an associated carrier material, said component comprising:

metal platelets, said metal platelets being disposed side by side, said metal platelets having an application side, said application side being toward said associated carrier material;

linking members, said linking members being ring-like and being attached to said platelets,; and, a hot-melt adhesive layer (3), said hot-melt adhesive layer (3) being applied to said application side (2) of said metal platelet component (1); and, claws (4), said claws attached to said platelets, said claws selectively engaging said linking members (6).

2. The metal platelet component of claim 1 further comprising:

edges (9) about a periphery of the application side of the metal platelet component (1), the hot-melt adhesive layer (3) coating only the edges (9) of the component.

3. The metal platelet component of claim 2, characterized in that the hot-melt adhesive layer (3) consists of polyamide adhesives.

4. The metal platelet component of claim 1, characterized in that each metal platelet (5) has a depression (7) which selectively receives an associated gem (8).

5. The metal platelet component of claim 4, characterized in that the associated gems (8) are made of cut glass.

6. The metal platelet component of claim 5, characterized in that the gem (8) is affixed in the depression (7) in the metal platelet (5) by means of a thermostable adhesive.

7. The metal platelet component of claim 6 wherein the component is affixable to an associated fabric carrier via ironing.

8. The metal platelet component of claim 4, characterized in that the gem (8) is affixed in the depression (7) in the metal platelet (5) by means of a thermostable adhesive.

9. The metal platelet component of claim 8 wherein the component is affixable to an associated fabric carrier via ironing.

10. The metal platelet component of claim 1, characterized in that the metal platelets (5) are made of eloxed aluminum or brass.

11. The metal platelet component of claim 1, characterized in that the metal platelets are made of lacquered metal.

12. The metal platelet component of claim 1 wherein the component is affixable to an associated fabric carrier via ironing.

13. A metal platelet component to be used in association with an associated carrier material, said component comprising:

metal platelets, said metal platelets being disposed side by side, said metal platelets having an application side, said application side being toward said associated carrier material;

linking members (6), said linking members being attached to said platelets; and, a hot-melt adhesive layer (3), said hot-melt adhesive layer (3) being applied to said application side (2) of metal platelet component (1); and;

claws (4), said claws attached to said platelets, said claws selectively engaging said linking members (6), said hot-melt adhesive layer coating only said claws and a portion of the component adjacent the claws and not coating the linking members.

14. The metal platelet component of claim 13 further comprising:

edges (2) about a periphery of the metal platelet component (1), the hot-melt adhesive layer (3) coating only the edges (9) and areas adjacent the edges of the component.

15. The metal platelet component of claim 14, characterized in that the hot-melt adhesive layer (3) consists of polyamide adhesives.

16. The metal platelet component of claim 13, characterized in that the metal platelets (5) are made of eloxed aluminum or brass.

17. The metal platelet component of claim 13, characterized in that the metal platelets are made of lacquered metal.

18. The metal platelet component of claim 13 wherein said hot-melt adhesive layer (3) consists of polyamide adhesives.

19. The metal platelet component of claim 13, characterized in that the hot-melt adhesive layer (3) consists of polyamide adhesives.

20. A metal platelet component to be used in association with an associated carrier material, said component comprising:

metal platelets, said metal platelets being disposed side by side, said metal platelets having an application side, said application side being toward said associated carrier material; linking members, said linking members being attached to said platelets,; and, a hot-melt adhesive layer (3), said hot-melt adhesive layer (3) being applied to said application side (2) of said metal platelet component (1), each metal platelet (5) having a depression (7) which receives an associated gem, the depressions (7) being cone-shaped.

21. The metal platelet component of claim 20, characterized in that each conical depression (7) has a sack-shaped enlargement (11) at the apex of the cone (10).

22. The metal platelet component of claim 20 wherein each conical depression (7) is a truncated cone with a hole (12) at the apex of the cone (10).

* * * * *